US006050638A

United States Patent [19]

West, III

[11] Patent Number: 6,050,638

[45] Date of Patent: Apr. 18, 2000

[54] ARTICLE OF FURNITURE WITH SECURED COMPARTMENT

[76] Inventor: David T West, III, 1925 Maple Wood Dr., Hagerstown, Md. 21740

[21] Appl. No.: 09/183,801

[22] Filed: Nov. 2, 1998

[51] Int. Cl.[7] ..... A47C 31/00

[52] U.S. Cl. ..... 297/219.1; 297/188.09; 297/235.5

[58] Field of Search ..... 297/219.1, 188.01, 297/188.1, 188.09, 188.08, 188.12, 188.13; 312/235.5, 235.2, 239

[56] References Cited

U.S. PATENT DOCUMENTS

| | | | |
|---|---|---|---|
| Re. 11,834 | 6/1900 | Seng . | |
| D. 141,295 | 5/1945 | Wright . | |
| D. 173,828 | 1/1955 | Ziebell . | |
| 519,930 | 5/1894 | Still . | |
| 749,865 | 1/1904 | Jarvis | 297/188.09 |
| 1,577,091 | 3/1926 | Ahlstedt | 297/235.5 |
| 1,984,207 | 12/1934 | Ceslowitz | 297/188.09 |
| 2,033,795 | 3/1936 | Ward, Jr. . | |
| 2,703,600 | 3/1955 | Harper . | |
| 2,703,667 | 3/1955 | De Mello . | |
| 3,099,482 | 7/1963 | Woodruff, Sr. . | |
| 3,232,686 | 2/1966 | Syler | 312/235.5 |
| 5,533,783 | 7/1996 | Harms et al. | 297/188.09 X |
| 5,622,404 | 4/1997 | Menne . | |
| 5,683,137 | 11/1997 | McDonald et al. . | |
| 5,727,844 | 3/1998 | O'Quinn | 297/188.09 X |

FOREIGN PATENT DOCUMENTS

| | | | |
|---|---|---|---|
| 214095 | 8/1960 | Austria . | |
| 227401 | 5/1963 | Austria | 297/188.09 |
| 1515204 | 1/1968 | France . | |
| 3512581 | 10/1986 | Germany . | |
| 1326228 | 7/1987 | U.S.S.R. | 297/188.09 |

*Primary Examiner*—Laurie K. Cranmer
*Attorney, Agent, or Firm*—Dowell & Dowell, P.C.

[57] ABSTRACT

An article of furniture such as a sofa, couch or love seat having a lockable compartment or enclosure within the seat in which articles and especially firearms may be securely and safely housed and wherein access to the compartment is concealed by a finished cover.

16 Claims, 2 Drawing Sheets

Fig.1
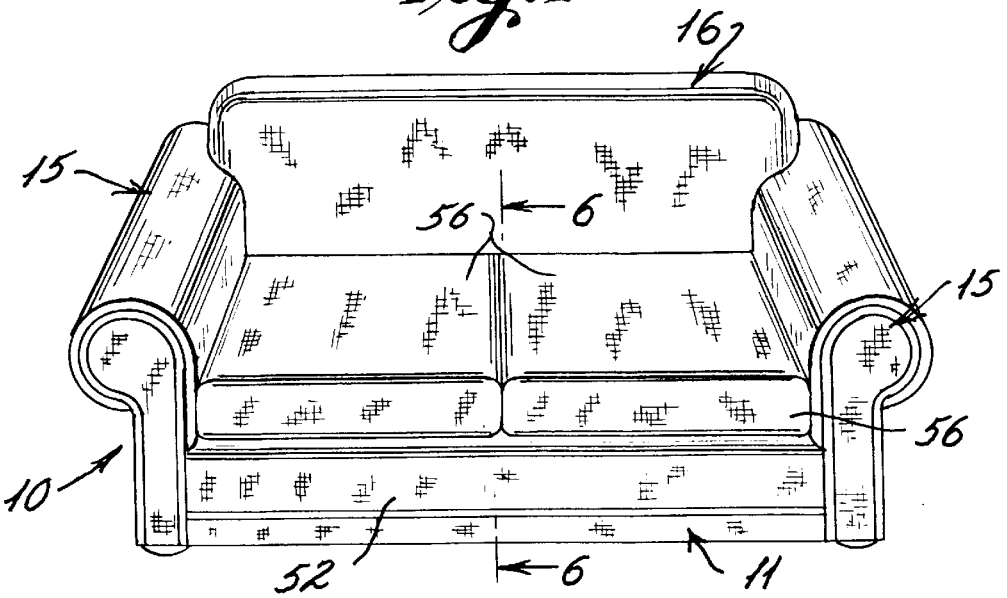
Fig.2
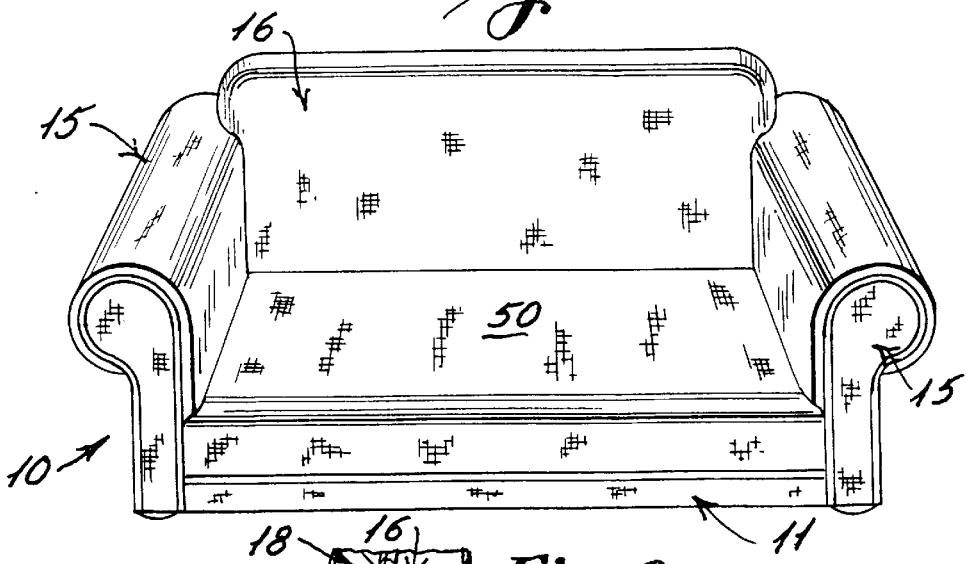
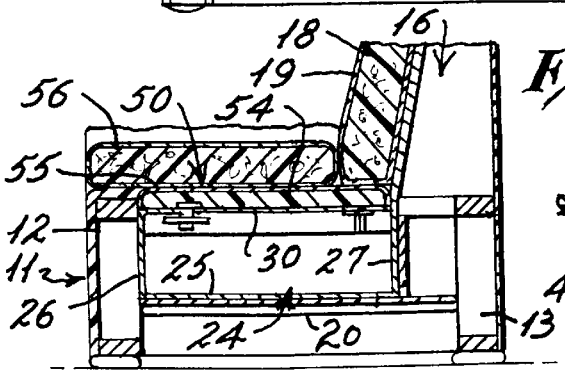
Fig.6
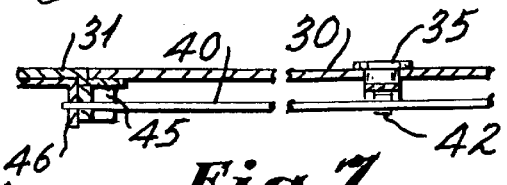
Fig.7

Fig.3
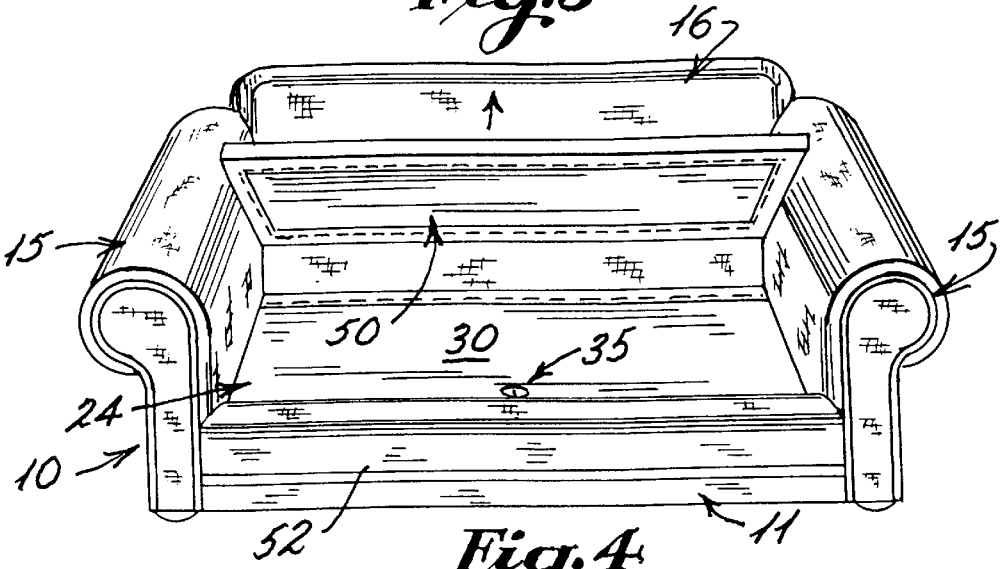
Fig.4
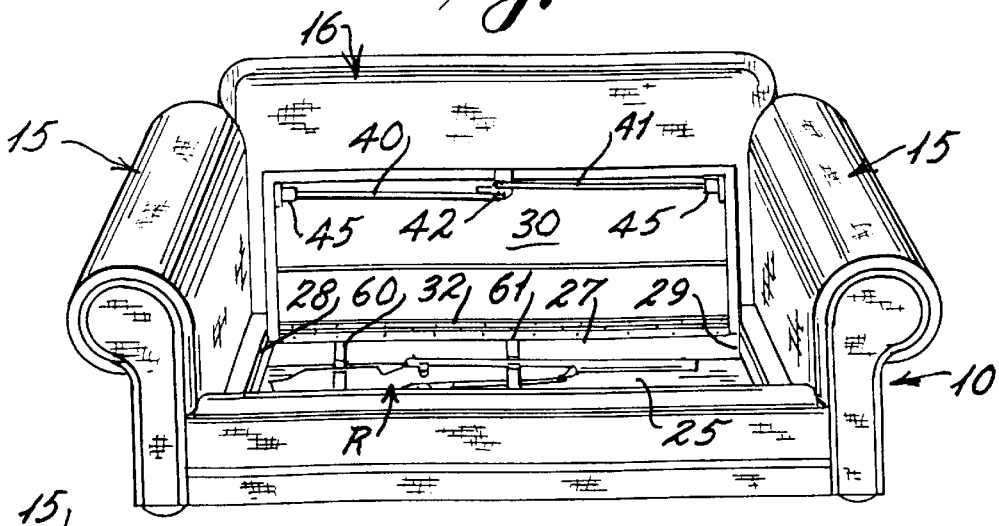
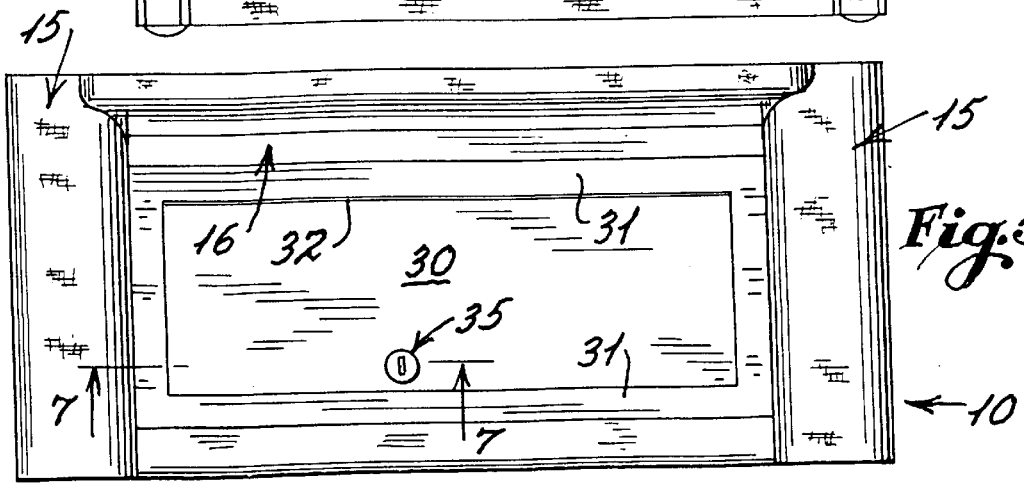
Fig.5

ARTICLE OF FURNITURE WITH SECURED COMPARTMENT

BACKGROUND OF THE INVENTION

1. Field of the Invention

The present invention is generally directed to secured storage areas and particularly to storage areas for securing firearms which are concealed to prevent access by children and other individuals. The invention is more specifically directed to a combination article of furniture such as a couch, sofa or lovest and a secured storage compartment which is housed in the seat of the article of furniture which is lockable and which is covered by a finished panel so as to be obscured from view.

2. History of the Related Art

In almost every residence there are articles of importance or value or articles which must be secured to provide safety and which articles require safe and secure storage. Unfortunately, most residences are not provided with adequate secured storage areas. Some residences are provided with built in storage areas such as lockable closets or safes. However, such built in storage areas are obvious or easy to recognize and can, therefore, be easily accessed by illegal entry.

In addition to valuables such as stocks, bonds, jewelry and the like which are often kept in a residence, many individuals keep firearms. Convention gun cabinets utilized to store firearms, such as pistols and rifles, frequently are provided with locking devices, however, the cabinets are fully viewable and accessible to anyone entering the residence. By circumventing a locking device, access can be obtained to the firearms. Therefore, there is a need to provide secured storage areas which are not readily apparent or obvious to someone entering a residence or business.

It has long been known to modify various articles of furniture so as to provide additional storage space. By way of example, U.S. Pat. No. 2,703,600 to Harper discloses an article of furniture having a storage space. The furniture disclosed is a couch or sofa having a storage area mounted in the bottom or seat. The storage area is accessible by sliding panels which are mounted along the front portion of the couch. Although such an article of furniture provides for additional storage, the dual capacity of the article of furniture for use as a seat as well as a storage area is outwardly obvious. Therefore, the furniture cannot function to provide a concealed storage space or compartment.

In U.S. Pat. No. 2,703,667 to DeMello a combination seat and utility box is disclosed wherein access to the box mounted within the base of the seat is obtained by simply raising the seat pad or cushion. Although this structure provides a less obvious appearance for a storage area, access to the storage area is easily obtained and can be accidentally discovered by individuals, especially children who may be playing on or around the furniture. A similar seating system for use with boats is disclosed in U.S. Pat. No. 5,622,404 to Menne. Again, with such a structure, the concealed storage area is not secured and therefore articles stored within such areas are not fully protected from theft or accidental access by individuals who should not obtain possession of articles being stored, such as a childs access to firearms.

SUMMARY OF THE INVENTION

The present invention is directed to a combination article of furniture and secured storage area which, in the preferred embodiment, is directed to a couch, sofa or love seat of the type which incorporates a frame which supports one or more seat cushions and from which extends a back which also may include one or more cushioned pads which are appropriately covered with a finishing material or fabric. Mounted within the lower frame of the couch is a storage compartment which includes opposite end and side walls which are sealed along their lower edge by a bottom wall. A lid is pivotally attached to an upper wall flange of the compartment or is otherwise mounted so as to be movable with respect to the base of the compartment when authorized access is desired. In the preferred embodiment, a locking mechanism is provided which includes a latch assembly which pivots locking bars to engage the lid with respect to the walls of the compartment to prevent raising of the lid when locked. An appropriate lock may be associated with the latch assembly to prevent manipulation of the latch assembly.

The invention further provides a finished cover which is mounted over the compartment so as to obscure the latching device for the enclosure and to provide a finished look for supporting one or more seat cushions associated with the article of furniture. In the preferred embodiment, the covering panel is upholstered to provide a very finished appearance beneath the seat cushions such that if the cushions are removed the bottom of the couch appears to be conventionally upholstered. In some embodiments, the upholstered cover may also be provided with inner springs, foam or other padding material to provide additional resilient support for the seat cushions.

In a preferred embodiment of the invention, the enclosure or compartment and the lid for the compartment are manufactured of a metallic material such that access through the side walls of the compartment is substantially prevented. Also, in the preferred embodiment, the size of the compartment is sufficient to house articles such as rifles and the like and may include a gun rack which also may include a separate locking mechanism for securing firearms within the compartment.

It is the primary object of the present invention to provide an unobvious and secured area for storage of valuables and for storage of articles such as weapons to thereby prevent access to such articles by unauthorized individuals including children.

It is yet a further object of the present invention to provide an article of furniture which appears and functions as a convention article of furniture and yet which functions as a secured storage area which is not noticeable to an ordinary observer.

It is also an object of the present invention to provide a secured storage compartment for firearms which includes a lockable compartment which is concealed within the base of an article of furniture and which compartment is covered by an upholsted cover which supports the seat cushions of the article of furniture such that, if the seat cushions are removed, the appearance of the article of furniture does not disclose the secured compartment.

BRIEF DESCRIPTION OF THE DRAWINGS

A better understanding of the invention will be had with reference to the attached drawings wherein:

FIG. 1 is a front perspective view of a couch or love seat incorporating the secured storage compartment of the present invention;

FIG. 2 is a front plan view of the couch of FIG. 1 showing the seat cushions removed and showing the secured compartment being obscured;

FIG. 3 is a front plan view of the sofa or love seat of FIG. 1 with the seat cushions removed and showing the upholstered cover being raised to show the closed lid for the secured compartment mounted within the base of the couch or love seat;

FIG. 4 is a front elevational view of the sofa of FIG. 1 showing the lid of the secured compartment being unlocked and pivoted to a raised position to allow access to the compartment;

FIG. 5 is a top plan view of the lid and locking latch assembly associated with the secured storage compartment;

FIG. 6 is a partial cross-sectional view through the secured storage compartment taken along line 6—6 of FIG. 1; and FIG. 7 is a partial cross-sectional view showing the locking bar assembly for securing the lid of the secured storage compartment taken along line 7—7 of FIG. 5.

DESCRIPTION OF THE PREFERRED EMBODIMENT

With continued reference to the drawing figures, an article of furniture is shown in the form of a couch, sofa or love seat 10 having a support base 11 which is covered with an appropriate fabric material and which is mounted to front and rear legs 12 and 13 provided within opposite arm portions 15 thereof. The arms are covered with an appropriate padding with the padding being covered by a fabric or other material such as leather or vinyl. Mounted to the rear portion of the frame 11 and extending upwardly therefrom is a back 16 which is covered with a cushion 18 and a fabric material 19.

To enclose the bottom or underside of the sofa, a bottom panel 20, formed of a fabric, wood or wood fiber material is mounted to the frame so as to extend between the legs at the opposite sides of the couch. The panel 20 extends from the back legs to the front legs and substantially encloses the underside of the sofa.

Mounted above the panel 20 and to the frame 11 is a secured storage compartment 24 which is shown in more detail in FIGS. 4 through 7. The compartment includes a bottom wall 25, front and rear walls 26 and 27, and opposite side walls 28 and 29. The walls are either integrally formed with the bottom wall 25 or are welded or otherwise sealed with respect to one another so as to prevent tampering or access through the walls or the bottom to a centralized storage area defined thereby. In the preferred embodiment, the compartment is formed of metal so as to provide additional security. The upper portion of the compartment includes a lid 30 which, in the preferred embodiment, is hinged to a top flange portion 31 of the compartment by way of an elongated hinge assembly 32. The flange portion of the top of the enclosure as well as the lid 30 are also preferably formed of metal to prevent tampering. To secure the lid in a closed relationship to prevent unauthorized access to the area within the compartment, a key lock assembly 35 is provided. As shown in FIG. 4, the lock assembly includes a pair of locking arms 40 and 41 which are pivotally connected to a crank assembly 42 that is mounted to a locking cylinder 43, as shown in FIGS. 5 and 6. The locking arms 40 and 41 are guided adjacent their outer ends by sleeves 45 which are fixed to the outer flange 31 of the top of the enclosure. By rotation of the crank assembly 42, the arms 40 and 41 are caused to be either pulled inwardly so as to release the end portions from a locking engagement beneath the flange portion 31 of the top of the compartment or moved outwardly to an extended position beneath the flange portion to prevent the lid from being raised. To facilitate the locking, the flange portion 31 of the compartment may include a pair of depending tabs such as shown at 46 in FIG. 7 having slotted openings therein through which the outer ends of the locking arms are slidingly received when extended to the locked position as shown in FIG. 7.

To completely obscure the compartment 24 from view, the present invention incorporates a cover 50 of a size to completely overlie the top of the compartment and which extends between the opposite arm portions 15 of the couch and from a front upholstered portion 52 thereof to the back 16 beneath the upholstered potion 18, as shown in FIG. 6. In the preferred embodiment, the cover 50 is provided with padding 54 which is covered with an appropriate upholstery fabric or material 55 such that the cover has a very finished upholstered appearance which would not give any indication that a secured storage compartment is mounted beneath the cover within the base of the couch. As shown in FIG. 1, the pad is normally covered by one or more conventional seat cushions 56. Springs may also be provided within the upholstered cover.

Although various articles may be stored within the secured storage compartment 24, in the preferred embodiment, the storage compartment is specifically designed to retain firearms such as a rifle "R". In this respect, a pair of support racks 60 and 61 are mounted within the storage compartment and appropriately contoured to support the butt and stock portion of the rifle or other firearm. The interior surface of the compartment may be covered by an appropriate fabric material to prevent any damage to articles which are stored therein. Further, conventional locks normally associated with gun racks may be utilized to secure the rifle or other firearms to the support racks mounted within the storage compartment.

With the structure of the present invention, the article of furniture appears to be conventional and there is no suggestion that a secured storage compartment is mounted within the base thereof. In the event the seat cushions 56 are accidentally moved from the seat of the sofa or love seat, the upholstered cover or pad mounted beneath the cushions presents a finished appearance and there is no indication that it can be removed or raised to provide access to a secured compartment. By lifting the upholstered cover an individual having knowledge of the secured compartment may obtain access to the locking assembly and through use of an appropriate key can unlock the lid to obtain access to the area within the compartment. Although not shown in the drawing figures, the padded cover may be hinged relative to the frame of the couch to thereby permit pivotal movement of the cover as opposed to the lifting movement discussed above.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A hidden security storage apparatus comprising; a seating device including a support frame and having a seat with at least one removable cushion normally positioned thereon, a secured and hidden enclosed storage compartment mounted within the support frame and including an interior and a lid for sealing the interior from access, securing means mounted to said lid for normally retaining said lid in covering relationship to said interior, a cover member supported in covering relationship to said lid and disposed intermediate said lid and said at least one cushion, said cover member having a finished appearance whereby said storage compartment is hidden from view when said at least one cushion is removed.

2. The apparatus of claim 1 including means for locking said lid to said compartment.

3. The apparatus of claim 2 including gun rack means mounted within said compartment adapted to support a butt and stock of a firearm.

4. The apparatus of claim 3 in which said cover member is upholstered to include an inner resilient material covered by an outer covering material.

5. The apparatus of claim 4 including a panel member mounted to an underside of said seating device such that said secured and hidden storage compartment is not visible from beneath said seating device.

6. The apparatus of claim 5 in which said seating device is selected of a group of seating device consisting of a couch, a love seat and a sofa.

7. The apparatus of claim 1 in which said compartment includes front, rear and opposite side walls, a bottom wall and an upper flange portion, said securing means including locking arms which are moveable with respect to said flange portion such that said lid cannot be raised when said locking arms are moved to a position beneath said flange portion.

8. The apparatus of claim 7 in which said compartment and said lid are formed of a metallic material.

9. The apparatus of claim 7 including means for locking said lid to said compartment.

10. The apparatus of claim 7 including a panel member mounted to an underside of said seating device such that said secured and hidden storage compartment is not visible from beneath said seating device.

11. The apparatus of claim 1 in which said seating device is selected of a group of seating devices consisting of a couch, a love seat and a sofa.

12. The apparatus of claim 1 including a panel member mounted to an underside of said seating device such that said secured and hidden storage compartment is not visible from beneath said seating device.

13. The apparatus of claim 12 in which said seating device is selected of a group of seating devices consisting of a couch, a love seat and a sofa.

14. A hidden security storage apparatus comprising; a seating device including a support frame and having a seat with at least one removable cushion normally positioned thereon, and a backrest, a secured and hidden enclosed storage compartment mounted within the support frame, said compartment including front, rear and opposite side walls, a bottom wall and an upper portion, an interior and a lid for sealing the interior from access, securing means mounted to said lid for normally retaining said lid in covering relationship to said interior, a cover member supported in covering relationship to said lid and disposed intermediate said lid and said at least one cushion, said cover member having a finished appearance whereby said storage compartment is hidden from view when said at least one cushion is removed, and means for locking said lid in covering relationship to said interior of said compartment.

15. The apparatus of claim 14 in which said cover member is upholstered to include an inner resilient material covered by an outer covering material.

16. The apparatus of claim 14 including a panel member mounted to an underside of said seating device such that said secured and hidden storage compartment is not visible from beneath said seating device.

* * * * *